United States Patent [19]

Suyama et al.

[11] Patent Number: 4,811,997

[45] Date of Patent: Mar. 14, 1989

[54] DISHWASHER

[75] Inventors: Koji Suyama; Akiyoshi Yoshida, both of Toyoake, Japan

[73] Assignee: Hoshizaki Electric Co., Ltd., Toyoake, Japan

[21] Appl. No.: 158,236

[22] Filed: Feb. 19, 1988

[51] Int. Cl.[4] ..... A47B 51/00

[52] U.S. Cl. ..... 312/228; 98/115.4; 312/272.5; 312/292; 312/312

[58] Field of Search ..... 134/115 R, 200, 201; 312/272.5, 285, 292, 323, 228, 312; 98/115.4

[56] References Cited

U.S. PATENT DOCUMENTS

| | | | |
|---|---|---|---|
| 1,208,153 | 12/1916 | Heath | 98/115.4 X |
| 1,628,818 | 5/1927 | Zademach | 134/200 X |
| 2,633,399 | 3/1953 | Haas | 134/200 X |
| 3,049,391 | 8/1962 | Meeker et al. | 312/292 X |
| 3,279,874 | 10/1966 | Noren et al. | 134/200 X |
| 3,949,772 | 4/1976 | Hartmann | 134/200 X |
| 4,073,555 | 2/1978 | Noren | 312/272.5 X |
| 4,134,413 | 1/1979 | Noren | 134/200 X |

*Primary Examiner*—Philip R. Coe

*Attorney, Agent, or Firm*—Wenderoth, Lind & Ponack

[57] ABSTRACT

A dishwasher comprises a main body having a washing tub. A box-like cover is mounted above the washing tub to be movable between a lower position to close the washing tub and an upper position to expose the tub. A supporting frame having a channel-like cross section for supporting the cover and guiding the movement thereof is mounted so as to extend from the washing tub into the interior of the cover. A pair of coil springs are provided to the inside of the channel-like supporting frame and have respective lower ends secured on the supporting frame at the inner side thereof and respective upper ends secured to a shield member which assumes a blocking position to substantially close an opening formed in a top wall of the cover when the latter is at the upper position while assuming a releasing position where the top opening of the cover is released from the blocked state. The shield member is swingable between the blocking position and the releasing position.

8 Claims, 3 Drawing Sheets

DISHWASHER

BACKGROUND OF THE INVENTION

1. Field of the Invention

The present invention relates in general to a machine for washing the dishes or the like (hereinafter referred to as a dishwasher) and more particularly to the dishwasher of a novel and simple structure which allows it to be installed with the back thereof positioned closely to a wall of a room in which the dishwasher is used, while assuring the enhanced venting of vapor from the inner space of a dishwasher.

2. Prior Art

Heretofore, a variety of dishwashers having various types of structures have been developed and used, as exemplified by those illustrated in FIGS. 7, 8 and 9 of the accompanying drawings. Referring to FIGS. 7 and 8 which show a typical conventional dishwasher, where a generally box-like main body 1 of the dishwasher includes a rear wall plate 1*a* and a vertical supporting frame 2 which is fixedly mounted on the rear wall plate 1*a* at a top portion thereof and has side plates 2*a* bent inwardly. A vertically movable box-like cover or door 3 is disposed in the supporting frame 2, the cover 3 having an open bottom and an open rear portion, respectively. A handle formed of a tubular member in a rectangular closed loop is pivotally mounted on the side plates 2*a* of the supporting frame 2 by means of pin and bracket assemblies 5, respectively, in such a manner as to encircle the cover 3, whereby the handle 4 can be swung selectively in the directions indicated by the double-headed arrow in FIG. 7. Pins 6 are mounted on the side arms of the rectangular handle 4, respectively, each of the pins 6 being operatively connected to a link member 8 at one end 8*a* thereof. The other end portion 8*b* of the link 8 is operatively connected to the side wall of the cover 3 at a lower portion 9 thereof. A pair of retainers 11 are integrally formed with a rear portion 4*a* of the rectangular handle 4 for fixedly holding the top ends of a pair of tension springs 12, which springs 12 have respective bottom ends 12*b* fixedly retained by a pair of brackets 13 mounted integrally on the rear wall 1*a* of the washer body 1. Further, an opening 14 is formed at the rear side of the cover 3, as is best shown in FIG. 8 which is a vertical sectional view illustrating the dishwasher of FIG. 7 with the handle 4 being omitted. A washing tub 15 having an open top is formed in the dishwasher main body 1.

The dishwasher may be provided with various equipment such as a dish rack, a washing fluid nozzle, a hot-water nozzle for rinsing, a drying apparatus for drying the washed and rinsed dishes or the like and other means required for the dishwasher. A dishwasher system including these accessories is disclosed, for example, in Japanese Patent Publication No. 49-2829.

When the dishes (not shown) are to be placed within the washing tub 15 or to be taken out therefrom, the handle 4 is lightly lifted upward. Since the cover 3 is usually urged upwardly under the force of the tension springs 12 by way of the handle 4, the cover 3 is then moved upwardly under the action of the springs 12 by way of the link members 8, resulting in that the washing tub 15 is exposed to the exterior through the open top thereof. At the same time, the opening 14 formed on the rear side of the cover 3 is moved to the position above the supporting frame 2. Thus, vapor produced in the washing tub 15 can be vented through the open rear portion 14 of the cover 3, following a flow path indicated by arrows in FIG. 8, so as not to vent upon the operator standing in front of the dishwasher.

The structure of a dishwasher also known heretofore and shown in FIG. 9 differs from the one described above in reference to FIGS. 7 and 8 in that a top plate 16 having an opening 17 formed therein is mounted on the supporting frame 2 at a top edge thereof and extends horizontally into the interior of the cover 3 which in turn is provided with a cap 18*a* and an opening 18 in the top wall thereof, wherein the cap member 18*a* is adapted to close the abovementioned opening 17 of the supporting frame 2 when the cover 3 moved downwardly has attained the position to close the washing tub 15. As will be seen in FIG. 9, vapor is vented to the exterior through the openings 17 and 18.

The prior known dishwashers of the structures described above suffer from the shortcomings mentioned below:

(1) Since the handle 4 is in the form of a closed rectangular loop, it must be disposed outside of the cover 3 and the supporting frame 2. Further, a portion of the handle 4 as well as the tension springs 12 are exposed at the rear side of the washer body. Consequently, the dishwasher can not be installed with its rear wall or panel flush against the wall of a room in which the dishwasher is to be installed, as a result of which the width and depth taken up by the dishwasher are increased considerably, requiring a large space for installing the dishwasher.

(2) From an aesthetic standpoint, the exposed rectangular handle 4 requires high quality finishing which involves high manufacturing costs.

(3) With the dishwasher structure shown in FIGS. 7 and 8, vapor is vented from the rear side. Consequently, when the dishwasher is installed with the rear side next to a wall, the latter will be adversely affected such as by deposition of condensate, growth of mold and other objectionable phenomena.

(4) In the case of the washer structure shown in FIG. 9, the weight of the cover 3 can be decreased correspondingly and is easy to handle due to the presence of the opening 18 formed in the top plate thereof. However, since the supporting frame 2 has the top plate 16 fixedly mounted thereon, the flow of vapor taking place upon opening of the cover 3 tends to be unstable, resulting in that vapor is likely to escape beyond the front bottom edge of the cover 3 to reach the hands and face of the user.

(5) In the structure shown in FIG. 9, the openings are formed in the top plates of the supporting frame 2 and the cover 3, respectively. Consequently, the structure becomes complicated, causing increased manufacturing costs.

(6) With respect to the size of the opening, it is noted that the opening 14 formed in the rear side of the cover 3 in the structure shown in FIGS. 7 and 8 can not cover a large area because the opening faces a room wall. On the other hand, in the case of the structure shown in FIG. 9, a limitation is imposed on the size of the opening formed in the top plate 3*a* of the cover 3 because the cap 18*a* must be provided partially surrounded by the opening 18.

(7) Since the top plate of the cover and/or of the supporting frame is usually held horizontally, there is the danger that hot water droplets may fall on and possibly scald the hands of the operator to their great discomfort, when they put their hands in the washing tub after opening the cover. Further, there is the danger that the rinsed dishes may be contaminated with droplets of washing water. In that case, the dishes have to be washed again, creating another problem.

SUMMARY OF THE INVENTION

Accordingly, it is an object of the present invention to solve the problems described above and provide a dishwasher which can be implemented in a very compact structure as a whole and installed with a rear side or the back of the dishwasher flush to a wall of a room where the washer is to be used, while assuring an improved vapor venting feature or capability.

Another object of the present invention is to provide a dishwasher in which droplets, contaminants or the like deposited on the inner surface of the cover can be introduced into the washing tub without dropping onto the dishes.

A further object of the present invention is to provide a dishwasher which can facilitate the dish drying process performed in succession to the washing cycle.

In view of the above and other objects which will be more apparent as the description proceeds, there is provided according to the present invention in the broadest aspect thereof a dishwasher which comprises a main body defining therein a washing tub having a top opening; a box-like cover disposed above said main body for movement between a lower position at which the top opening of said washing tub is closed by said cover and an upper position at which said top opening of said washing tub is opened, said cover being constituted by a front portion provided with a handle, a rear portion, an open bottom portion, a top portion having an opening formed therein, and a pair of side portions for connecting together said front portion, said rear portion and said top portion; means provided on the side of said rear portion of said main body for supporting said cover and guiding the movement thereof; a shield member having a rear end portion and a front end portion, said shield member being disposed within said cover and pivotally mounted on said supporting and guiding means at said rear end portion thereof located close to said rear portion of said cover so as to be swingable between a blocking position where said shield member substantially closes said opening formed in said top portion of said cover when said cover is at said lower position and a release position where said opening formed in said top portion of said cover is released from the blocked state when said cover is at said upper position; means pivotally coupled at one end thereof to a portion of said shield member at a position spaced away from said rear end portion of said shield member and at the other end to said cover at a lower portion thereof for translating the movement of said cover to rotation of said shield member; and means disposed internally of said supporting and guiding means for normally urging said cover toward said upper position.

When the cover is located at the lower position for closing the opening of the washing tub, the shield member assumes the closing or blocking position where the shield member engages the top portion of the cover and closes substantially closes the opening formed in the top portion of the cover. In this state, predetermined operations such as washing, rinsing and drying of the dishes can be carried out. Subsequently, when the cover is moved to the upper position by correspondingly manipulating the handle mounted on the front portion of the cover, the shield member is set to an inclined state within the cover by interlocking with the movement of the cover to assume the open position under the action of the translating means and the urging means, whereby the top opening formed in the top portion of the cover is released or opened. Consequently, a part of the vapor in the washing tub can pass through the opening formed in the shield member while another part of the vapor is guided along the inclined shield member to be ultimately discharged through the top opening of the cover.

In a preferred embodiment of the invention, the lower peripheral edge portion of the cover defining the bottom opening thereof may be bent inwardly to thereby form top-opened grooves or channels, wherein those channels extending along the lower ends of the side portions are disposed with an inclination from the front to the rear side of the dishwasher so that water droplets deposited on the inner surface of the cover and tending to flow downwardly can be collected and introduced into the washing tub through the channels.

BRIEF DESCRIPTION OF THE DRAWINGS

The invention will become more readily apparent from the following description of preferred embodiments thereof shown, by way of example only, in the accompanying drawings, in which like reference characters designate like or corresponding parts, and wherein.

DESCRIPTION OF THE PREFERRED EMBODIMENTS

Figure 1:
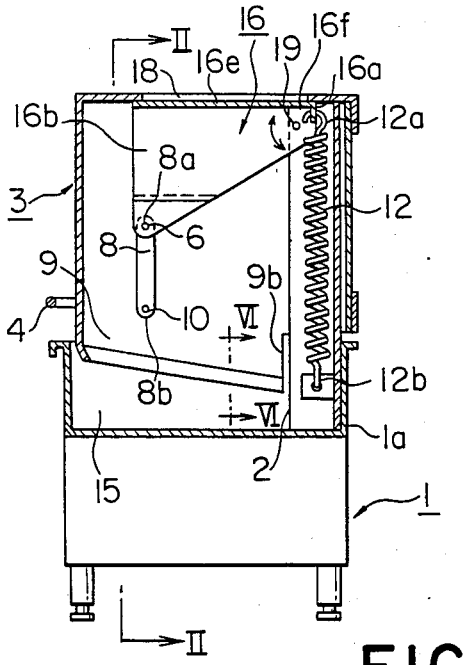
FIG. 1 is a view showing, in vertical section, a dishwasher according to a preferred embodiment of the invention with a cover being closed.
Figure 2:
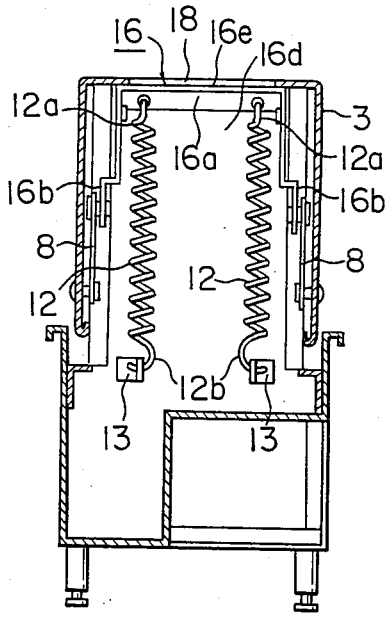
FIG. 2 is a vertical sectional view of the same taken along the line II—II in FIG. 1.

Referring to the drawings and in particular to FIGS. 1 and 2, there is shown in vertical sectional views a dishwasher according to a preferred embodiment of the present invention. The dishwasher includes a main body 1 of a generally box-like configuration and having an open topped washing tub 15 formed therein. A vertical supporting frame 2 having a generally inverted U-like or channel-like section is fixedly mounted on the rear portion 1*a* of the main body 1, as is with the case of the hitherto known dishwasher described hereinbefore. A cover 3 having an open bottom is supported to be vertically movable in such a manner as to enclose therein the supporting frame 2, as will be described in detail hereinafter. The cover 3 has a generally box-like structure and includes a front plate provided with an arcuate handle 4 of a small size, a rear plate is disposed in spaced opposed relation to the front plate, a pair of side plates interconnecting the front and rear plates along the corresponding edges thereof and a top plate secured fixedly to the front, rear and side plates at the upper edges thereof, and the top plate is formed with an opening 18 substantially at a center portion thereof as shown, which opening may be of any suitable form such as rectangular or the like.

Disposed between the inwardly extending side plates or portions 2*a* of the supporting frame 2 at an upper portion thereof is a shield plate member 16 of a generally dustpan-like structure, that is, having a pair of vertical side plates 16*b* each of a generally triangular form which are pivotally connected at respective ends 16*f* to the corresponding side plates of the supporting frame 2 by means of pins 19 so that the shield plate member 16 can be rotated or swung in either one of the directions indicated by the double-headed arrow in FIG. 1. A retainer 16*a* having respective holes is provided at the aforementioned end portion 16*f* of the shield plate member 16, wherein the top ends 12*a* of a pair of coil springs 12 disposed within the channel-like space defined by the supporting frame 2 of the dustpan-like structure are engaged in the holes of the retainer 16*a*, respectively. These coil springs 12 have respective bottom ends 12*b* which are secured to brackets 13 provided at the lower end of the supporting frame 2. The vertical triangular side plates 16*b* of the shield plate member 16 are pivotally connected at respective ends remote from the aforementioned end 16*f* to one end 8*a* of elongated plate-like links or coupling members 8, respectively, by means of pins 6. The coupling members 8 have respective other end portions 8*b* at which the coupling members 8 are rotatably connected to the side plates of the cover 3 at respective lower portions 9 by means of pins 10. With the mounting structure described above, the shield plate member 16 can be rotated or swung about pins 19 in the direction indicated by the double-headed arrow within the cover 3 in FIG. 1.

Figure 4:
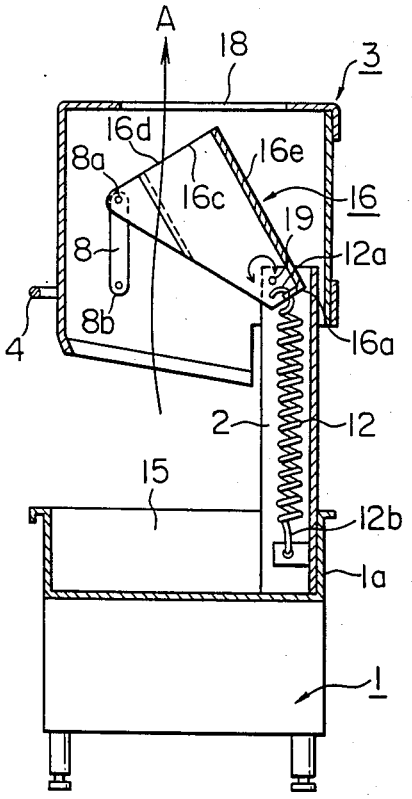
FIG. 4 is a sectional view similar to FIG. 1 and shows the dishwasher with the cover being opened.

The front portion 16*c* of the shield plate member 16 of the dustpan-like structure defines an opening 16*d*, so that when the cover 3 is lifted upwardly, as described hereinafter (see FIG. 4), steam produced in the washing tub 15 provided in the main body of the dishwasher can be vented outwardly through the open bottom of the cover 3, the front and bottom openings of the shield plate member 16 and the top opening 18 of the cover 3, as indicated by arrow A in FIG. 4.

In conjunction with the structure described above, it should be mentioned that the tension of the springs 12 which exerts a force to urge the cover 3 upwardly by way of the shield plate member 16 and the links or coupling members 8 is selected to be in balance with the weight of the cover 3 and the shield plate member 16 and the links 8, under which weight the cover 3 is urged toward the lower position.

Figure 6:
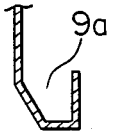
FIG. 6 is a partial sectional view taken along the line VI—VI in FIG. 1.
Figure 7:
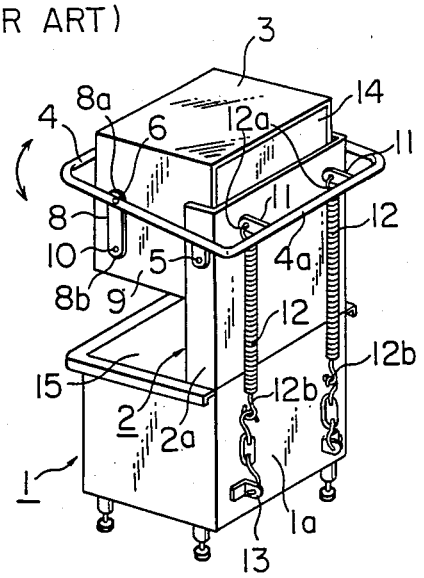
FIG. 7 (PRIOR ART)
FIG. 7 is a perspective view showing a dishwasher known heretofore as viewed from the rear side thereof.
Figure 8:
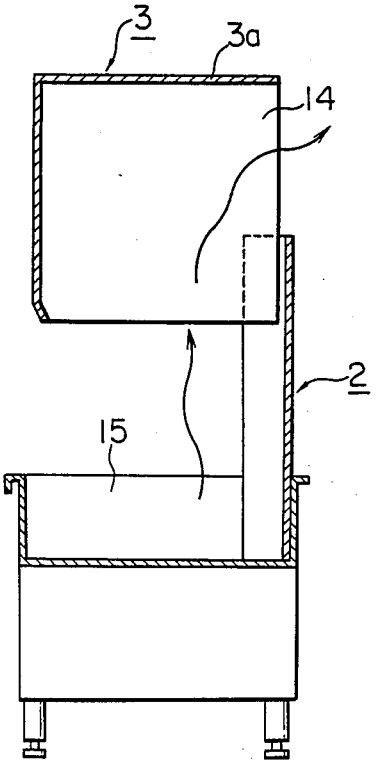
FIG. 8 (PRIOR ART)
FIG. 8 is a schematic sectional view of the dishwasher shown in FIG. 7.
Figure 9:
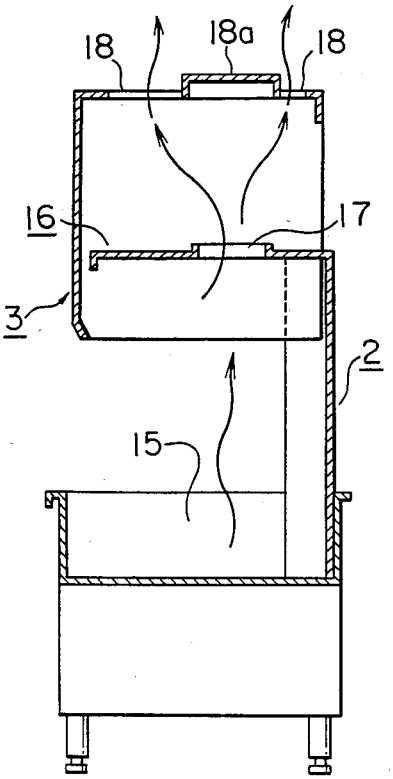
FIG. 9 (PRIOR ART)
FIG. 9 is a view similar to FIG. 8 and shows another example of the hitherto known dishwasher.

The front plate and the side plates of the cover 3 have respective bottom end portions each in the form of an open topped channel 9*a*, as shown in FIG. 6. More specifically, where the channel 9*a* is, for example, formed in the side plate of the cover 3 along the bottom end thereof, the channel 9*a* is disposed at a downward inclination from the front side of the cover 3 to the rear side thereof and bent inward of the cover 3, as can be clearly seen in FIG. 6. The channel 9*a* is communicated at the front end thereof with a corresponding channel formed along the lower edge of the front plate of the cover 3, while the rear end portion of the side channel 9*a* is opened. Further, in the case of the illustrated embodiment, a notch 9*b* (FIG. 1) is formed in each of the side plates of the cover 3 at a lower portion 9 thereof adjacent to the side plate of the supporting frame 2 in order to prevent the channels 9*a* formed in the side plates of the cover 3 from interfering with the supporting frame 2. It should be noted that there is no channel in the region of the notch 9*b*.

Figure 5:
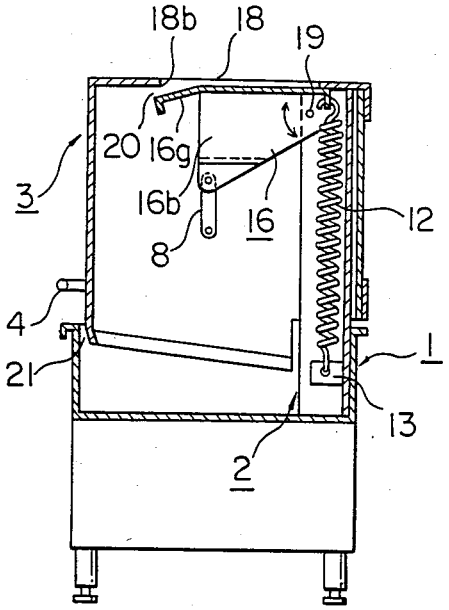
FIG. 5 is a view showing, in section, a dishwasher according to another embodiment of the present invention.

FIG. 5 shows a dishwasher according to another embodiment of the present invention. In the case of the dishwasher shown in FIGS. 1 to 4, the top plate 16*e* of the shield plate member 16 extends substantially horizontally to close tightly the top opening 18 of the cover 16 when the shield plate member 16 is moved to the blocking position. In contrast, in the case of the dishwasher shown in FIG. 5, the top plate 16*e* of the shield plate member 16 has a tip (front) end portion which projects frontwards beyond the front edges of the vertical side plates 16*b* to form a projecting portion 16*g* having an L-like cross-section and slightly inclined downwardly, as can be clearly seen in FIG. 5.

Parenthetically, it should be added that the dishwasher may be provided with various equipment such as a dish rack, a washing liquid nozzle, a hot-water nozzle for rinsing, a drying apparatus for drying the dishes or the like after washing and rinsing and other apparatus required for a dishwasher. For these accessories, reference may be made to Japanese Patent Publication No. 49-2829.

Figure 3:
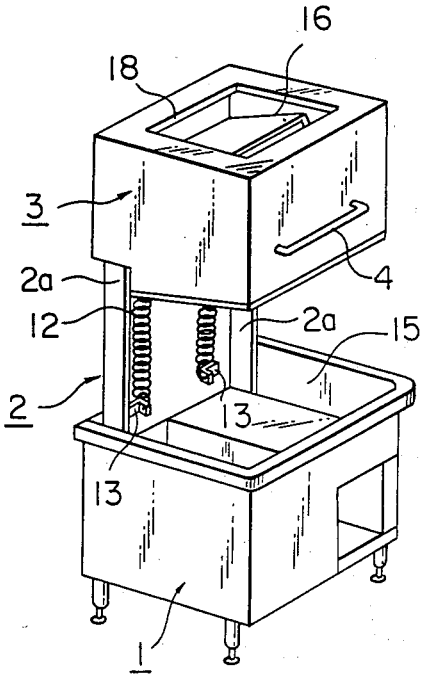
FIG. 3 is a perspective view showing the dishwasher of FIG. 1 with the cover being opened.

Next, operation of the dishwasher according to the invention will be described. In FIG. 1, the dishwasher is shown in the state after the dishwashing operation has been completed. Starting from this state, the cover 3 is lifted toward the upper position by gripping and lifting the handle 4. To this end, application of only a small force is sufficient because the upward movement of the cover 3 is aided by the tension exerted by the coil springs 12. The upward movement of the cover 3 is transmitted to the shield plate member 16 by way of the link or coupling members 8 to thereby cause the shield plate member 16 to rotate clockwise about the pins 19, resulting in that the shield plate member 16 moves from the position where the opening 18 formed in the top plate of the cover 3 is essentially closed. By moving the cover 3 upward toward its uppermost position, the washing tub 15 is exposed with the shield plate member 18 being completely moved away from the closing or blocking position, as illustrated in FIGS. 3 and 4. In the meantime, droplets of washing liquid, rinsing water or the like deposited on the inner surfaces of the cover 3 flow down therealong to be collected in the channel 9*a* formed in the front and side plates of the cover 3 along the bottom edges thereof to be thereby guided and introduced into the washing tub 15 by way of the side channels 9*a*. On the other hand, vapor filling the interior of the dishwasher is vented outwardly through the open bottom of the cover 3, the bottom and front openings 16*d* (FIG. 4) of the shield plate member 16 and the top opening 18 of the cover 3 under a negative pressure produced in the region underlying the shield plate member 16 through the rotation thereof as caused by the upward movement of the cover 3. Vapor impinging on the lower surface of the top plate 16*e* of the shield plate member 16 is guided therealong toward the top opening 18 of the cover 3 to be vented outwardly therethrough.

The washed and dried dishes can be easily taken out from the dishwasher in the state in which the cover 3 is held at the uppermost position described above.

Subsequently, when the dirty or contaminated dishes are to be washed or when the dishwasher is not to be used for a while, the handle 4 is pulled downwardly, whereupon the cover 3 is lowered against the force of the spring coils 12 under the weight of the cover 3 inclusive of the shield plate member 16 and other members to the lowermost position shown in FIG. 1 where the washing tub 15 is completely covered and concealed. In the course of the downward movement of the cover 3 described above, the shield plate member 16 is caused to rotate counterclockwise as viewed in FIG. 4 under the force transmitted from the cover 3 by way of the link members 8 to be brought to the position where the top opening 18 of the cover 3 is substantially blocked or closed by the top plate **16*e* of the shield plate member 16**.

As will be appreciated from FIGS. 1 to 5, the cover 3 is supported by the supporting frame 2 in a cantilever manner. Accordingly, the cover 3 may possibly undergo positional deviations in the widthwise direction. In this conjunction, it is noted that when the channels **9*a* are formed in the lower portions 9 of the side plates of the cover 3 with a downward inclination from the front to the rear side according to the teaching of the invention as described hereinbefore, the lower portions of the side plates of the cover 3 can enter the washing tub 15 progressively from the rear side toward the front side while engaging with the outer wall of the washing tub, as the cover 3 is moved downwardly, whereby the movement of the cover 3** in the vertical direction can be accomplished smoothly.

Now, turning to the embodiment shown in FIG. 5, a continuous gap 20 of small size is formed between the front portion of the peripheral edge **18*b* defining the top opening 18 of the cover 3 and the frontward projecting portion 16*g* of the shield plate member 16 by inclining the projecting portion 16*g* downward. Consequently, vapor produced in the washing tub 15 can escape upwardly through this gap 20 to the atmosphere, whereby the dishes being dried are protected from the adverse influence of vapor even when the drying process is performed with the cover 3 closed. Further, because of a gap 21 existing between the lower end portion of the front plate of the cover 3 and the front edge portion of the washing tub 15 even when the cover 3 is at its lowermost position shown in FIG. 5, vapor venting through the gap 20 is promoted due to the so-called chimney draft effect of these gaps 20 and 21. Further, since the projection 16*g* of the shield plate member is inclined downwardly, interference between the projection 16*g* and the peripheral edge 18*b* of the top opening 18 which would otherwise occur upon lifting of the cover 3 from the lowermost position shown in FIG. 5** can be positively prevented.

Thus, according to the preferred embodiments of the present invention, there can be attained the following advantageous effects in addition to those described in the foregoing.

(1) Since the handle is of a very small size and mounted on only the front portion of the cover, manufacturing costs can be reduced significantly.

(2) The coil springs are mounted at the inner side of the supporting frame having a channel-like section. Accordingly, the dishwasher can be installed neatly in such manner that the rear panel thereof is flush against a wall of a room where the dishwasher is used. Further, the space required for installing the dishwasher can be reduced for a given processing capability.

(3) As the cover is moved toward the upper position thereof, the shield plate member is rotated upwardly. At that time, a negative pressure is produced within the dishwasher, as the result of which the venting of vapor in the upward direction can be promoted.

(4) Since the shield plate member is rotatable, the area required for the draft of vapor can be increased, whereby vapor venting can be accomplished with high efficiency.

(5) Upon opening of the cover, the shield plate member is rotated to such attitude that the rear side thereof is lowered. Consequently, droplets deposited on the shield plate plate drop from the rear side within the dishwasher. Thus, the dishes can be prevented from being contaminated by the droplets, while the operator can be protected against unwanted accidents such as scalding by hot droplets.

(6) By virtue of the channels along the lower edges of the side plates of the cover formed by bending the lower edge portions inwardly at a downward inclination from the front side to the rear side of the dishwasher, water condensate deposited on the inner surfaces of the cover can be collected in the channel and caused to flow rapidly in the direction toward the rear side of the dishwasher. Thus, the interior space within the cover can be maintained in hygienic conditions. Further, sprinkling of water from the open ends of the channels located at the rear side can be positively inhibited, upon opening of the cover.

(7) Since the lower edge portions of the side plates of the cover are inclined in the manner described above, the cover can be opened and closed without any appreciable interference with the washing tub regardless of positional deviations in the cover, whereby the cover can be manipulated with improved efficiency while reliability and durability of the dishwasher as a whole can be significantly enhanced.

It is thought that the present invention will be understood from the foregoing description and it will be apparent that various changes may be made in the form, construction and arrangement thereof without departing from the spirit and scope of the invention or sacrificing all of its material advantages, the forms hereinbefore described being merely preferred or exemplary embodiments thereof. For example, in the case of the illustrated embodiment, the supporting frame is formed of a single sheet of material so as to have a channel-like cross section. However, the supporting frame in such a structure may have a pair of hollow posts disposed vertically with a space therebetween and a rear plate interconnecting the hollow posts along the entire length thereof, wherein the coil springs may be accommodated within the hollow posts, respectively. In this case, by mounting the hollow posts at a small distance from the side walls of the washing tub, respectively, so that a space is formed between the hollow posts and the side walls of the washing tub, a part of the water flowing downwardly in the channels formed in the side plates of the cover along the bottom edges thereof can enter the abovementioned space, whereby the sprinkling of water can be suppressed to a minimum. Further, the shield plate member may be provided with bent portions on the lateral sides in addition to the bent projection formed on the front side so that gaps are formed between the side plates of the shield plate member and the top opening of the cover when the latter is set to the blocking position.

What we claim is:

1. A dishwasher, comprising;

a main body defining therein a washing tub having a top opening, and further having a rear part;

a box-like cover disposed above said main body for movement between a lower position at which the top opening of said washing tub is closed by said cover and an upper position at which said top opening of said washing tub is opened, said cover being constituted by a front portion provided with a handle, a rear portion, an open bottom portion, a top portion having an opening therein, and a pair of side portions for connecting together said front portion, said rear portion and said top portion;

means provided on said rear part of said main body for supporting said cover and guiding the movement thereof between said lower position and said upper position;

a shield member having a rear end portion and a front end portion, said shield member being disposed within said cover and having said rear end portion pivotally mounted on said supporting and guiding means close to said rear portion of said cover so as to be swingable between a blocking position where said shield member substantially closes said opening in said top portion of said cover when said cover is at said lower position and an open position where said opening in said top portion of said cover is open when said cover is at said upper position;

means pivotally coupled at one end thereof to a portion of said shield member at a position spaced from said rear end portion of said shield member and at the other end to said cover at a lower portion thereof for translating the movement of said cover to rotation of said shield member; and means disposed internally of said supporting and guiding means for normally urging said cover toward said upper position.

2. A dishwasher according to claim 1, wherein said washing tub has side walls and wherein said supporting and guiding means includes a plate member extending from the interior of said washing tub into said cover, said plate member being shaped substantially in the form of a channel having longitudinal side portions bent inwardly along corresponding side walls of said washing tub.

3. A dishwasher according to claim 2, wherein said urging means includes a pair of coil springs which are disposed on the inside of said channel shaped plate member at positions close to said side portions of said cover, respectively.

4. A dishwasher according to claim 1, wherein said shield member includes a substantially flat top portion, a pair of substantially triangular side plates extending vertically downwardly from side edges of said top portion and defining an open front portion therebetween at said front end portion, and an open bottom, said shield member being disposed so that said open front portion and said open bottom of said shield member are substantially aligned with said opening in said top portion of said cover and said open bottom of said cover, respectively, when said shield member is located at said open position.

5. A dishwasher according to claim 4, wherein said translating means includes a pair of link members connected pivotally to said side plates at front end portions thereof, respectively.

6. A dishwasher according to claim 4, wherein said top portion of said shield member has a projecting portion at the front edge thereof, said projecting portion being bent downwardly to define a gap between said shield member and said opening in said top portion of said cover, even when said shield member is at said blocking position.

7. A dishwasher according to claim 6, wherein the lower end of the front portion of said cover is spaced from the upper end of said washing tub to define a gap between said lower end of the front portion of said cover and said upper end of said washing tub when said cover is at said lower position.

8. A dishwasher according to claim 1, wherein said front portion and said side portions of said cover are bent inwardly along respective lower edge portions to thereby form channels, respectively, the channels formed in said side portions of said cover being inclined downwardly from said front portion to said rear portion and having respective ends opened at said rear portion.

* * * * *